US007392656B2

(12) United States Patent
Onuma et al.

(10) Patent No.: US 7,392,656 B2
(45) Date of Patent: Jul. 1, 2008

(54) STEAM TURBINE PLANT

(75) Inventors: Masanori Onuma, Kasama (JP); Naoto Koizumi, Takahagi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/749,929

(22) Filed: May 17, 2007

(65) Prior Publication Data

US 2007/0266710 A1 Nov. 22, 2007

(30) Foreign Application Priority Data

May 18, 2006 (JP) ..... 2006-138591

(51) Int. Cl.
*F01K 7/34* (2006.01)

(52) U.S. Cl. ..... 60/653; 60/660; 60/677

(58) Field of Classification Search ..... 60/653, 60/660, 670, 677
See application file for complete search history.

(56) References Cited

U.S. PATENT DOCUMENTS 3,233,413 A * 2/1966 Wagner et al. ..... 415/17
4,638,630 A * 1/1987 Martens et al. ..... 60/39.182

FOREIGN PATENT DOCUMENTS

| | | |
|---|---|---|
| JP | 07-034809 | 2/1995 |
| JP | 07-180507 | 7/1995 |
| JP | 08-312309 | 11/1996 |
| JP | 10-110602 | 4/1998 |
| JP | 2000-161009 | 6/2000 |
| JP | 2000-257405 | 9/2000 |

* cited by examiner

*Primary Examiner*—Hoang M Nguyen
(74) *Attorney, Agent, or Firm*—Mattingly, Stanger, Malur & Brundidge, P.C.

(57) ABSTRACT

A steam turbine plant includes an extraction system and a control system for controlling the steam extraction. The extraction system includes an extraction steam flowmeter and a stop valve. The control system sets a warning flow and an extracted steam stop flow for the extracted steam. When the extracted steam flow reaches the warning flow, a warning is issued and after a lapse of a predetermined time period, the stop valve is opened to restrict the extracted steam flow. When the extracted steam flow reaches the extracted steam stop flow, the stop valve is closed to stop steam extraction. A steam turbine plant can thus exercise extraction control to stably supply extracted steam while avoiding turbine trip, even if not equipped with a high-performance and expensive valve device such as an extraction steam control valve.

3 Claims, 4 Drawing Sheets

FIG. 4 e: TURBINE EXPANTION LINE UNDER LOW-PRESSURE STEAM CONDITION f: DIFFERENCE BETWEEN TURBINE STEAM EXTRACTION POINT AND TURBINE THERMAL STRESS RESTRICTIVE VALUE UNDER LOWER-PRESSURE STEAM CONDITION g: TURBINE EXPANTION LINE UNDER HIGH-PRESSURE STEAM CONDITION h: DIFFERENCE BETWEEN TURBINE STEAM EXTRACTION POINT AND TURBINE THERMAL STRESS RESTRICTIVE VALUE UNDER HIGH-PRESSURE STEAM CONDITION m: TURBINE BLADE STRESS RESTRICTIVE VALUE

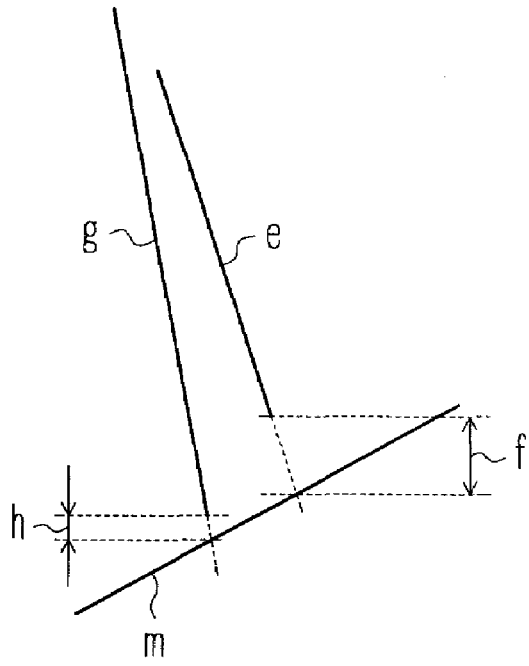

STEAM TURBINE PLANT

BACKGROUND OF THE INVENTION

1. Field of the Invention

The present invention relates generally to a steam turbine plant and more particularly to steam extraction control for an extraction turbine plant which extracts a portion of main steam from an intermediate stage of a steam turbine and delivers it to a demander.

2. Description of the Related Art

In general, a steam turbine plant extracts a portion of main steam from an intermediate stage of a steam turbine having a plurality of stages and delivers the extracted steam to a demander (e.g., turbine auxiliary machinery such as a feed-water heater and a deaerator, or a warming process in a power plant or various processes in factories attached with a power plant for personal use). Extracting steam from the intermediate stage of a steam turbine as described above means that a steam-reducing action in a steam turbine is used to provide steam with pressure needed by a steam demander.

Such an extraction turbine plant involves a problem with a turbine trip resulting from steam extraction. FIG. 3 represents the relationship between steam extraction structure and stage inlet/outlet steam differential pressure resulting from steam extraction. As seen from the figure, extracting steam from an intermediate stage increases stage inlet/outlet steam differential pressure. In such steam extraction structure, if an extracted steam flow exceeds a given level because of an abnormal increase in demanded amount of extracted steam, a pressure difference is excessively increased between a steam inflow portion and a turbine stage to which an extraction steam supply pipe is connected in a turbine. The stage inlet/outlet steam differential pressure produces stress on a turbine blade in such a manner that the turbine blade is pulled toward the downstream side of the turbine. If the stage inlet/outlet steam differential pressure exceeds the given level, the stress resulting from the stage inlet/outlet steam differential pressure exceeds the design intensity, which probably damages the turbine blade. In order to avoid such damage to the turbine blade, differential pressure between turbine stages has heretofore been monitored by a post-turbine-first-stage pressure gauge and an extracted steam pressure gauge. In general, if the differential pressure exceeds a predefined limit value, then the turbine is tripped.

In an extraction turbine plant used for power generation, shut-down of a steam turbine due to turbine trip causes a large economical loss. Therefore, steam extraction control is needed which can preferably avoid a turbine trip. On the other hand, in the steam extraction control it is important to stably supply extracted steam to a demander. The technique disclosed in JP-A-2000-257405 is known as a technique addressing such problems.

The steam turbine plant operating method disclosed in JP-A-2000-257405 targets the operation of a steam turbine plant which includes a flowmeter which measures extracted steam flow; an extraction steam control valve which controls the extracted steam flow; an extraction steam stop valve which stops extraction of steam; a post-turbine-first-stage pressure gauge which detects steam pressure at the steam inlet portion of the turbine; and an extracted steam pressure gauge which detects extracted steam pressure. In the normal state, the opening of the extraction steam control valve is feedback controlled based on the measurements of the extraction steam flowmeter and the demand plan amount of extracted steam. On the other hand, a difference between the respective measurements of the post-turbine-first-stage pressure gauge and extracted steam pressure gauge are constantly monitored. If the pressure difference exceeds a preset specified value, since the turbine runs into danger, one or both of the extraction steam control valve and extraction steam stop valve are fully closed to stop steam extraction. This can avoid tripping the turbine.

It is to be noted that steam extraction in a steam turbine is disclosed by JP-A-7-180507, JP-A-10-110602, JP-A-7-34809, JP-A-2000-161009 and JP-A-8-312309 as well as by JP-A-2000-257405.

SUMMARY OF THE INVENTION

The steam turbine plant operating method of JP-A-2000-257405 is excellent in terms of the fact that extracted steam can be stably delivered while it is primarily intended that the turbine can continuously be operated by avoiding occurrence of the turbine trip due to steam extraction. However, this technique needs specific conditions. One of them is that the steam turbine plant is provided with an extraction steam control valve which can continuously set its valve opening, thereby continuously varying the flow volume of extracted steam.

The other is that the steam conditions of the steam turbine plant is such that a difference between the post-turbine-first-stage pressure and extracted steam pressure can serve as an effective index with respect to the excess of the extracted steam amount. In other words, main steam delivered to the steam turbine plant has pressure lower than a certain level. FIG. 4 is a Mollier chart, which represents the relationship between steam conditions and turbine expansion lines, and the relationship between a difference between a turbine steam extraction point (steam extraction position) and a turbine thermal stress restriction value, and the steam condition. As seen from the diagram, as the steam condition varies, the turbine expansion line varies. That is to say, a low-pressure steam condition provides a turbine expansion line e but a high-pressure steam condition provides a turbine expansion line g. Thus, the difference between the steam condition of the turbine steam extraction point and a turbine blade stress restriction condition is decreased from a difference f to a difference h. The differences f and h correspond to pressure differences between the post-turbine-first-stage pressure and extracted steam pressure. In order to effectively exercise control based on the pressure difference reference method of JP-A-2000-257405, it is necessary to effectively detect such pressure differences. However, if the pressure difference is small as the difference h, a specific value of the pressure difference which is set by considering the inherent measuring error of the pressure gauge and the safety factor of control becomes less than a measurable pressure difference. It becomes difficult to exercise the control based on the pressure difference reference method. Thus, since the control based on the pressure difference reference method is restricted by the steam condition, it is necessary that the main steam delivered to the steam turbine plant should have a pressure lower than a given level.

Not all steam turbine plants meet such conditions. More specifically, putting emphasis on plant costs, some steam turbine plants omit an extraction steam control valve which is expensive because of provision of accessory equipment such as an operating system for continuous valve opening control. Adoption of a high-pressure steam condition for promoting high-efficiency has been increased in recent years. Therefore, there are increasingly cases where a pressure difference between post-turbine-first-stage pressure and extracted steam pressure cannot be taken as an index of an excessive amount of extracted steam.

In view of the forgoing, the present invention has been made and it is an object of the present invention to provide a steam turbine plant that can exercise steam extraction control capable of stably supplying extracted steam while it is primarily intended that the turbine can continuously be operated by avoiding occurrence of the turbine trip due to steam extraction even if the steam turbine plant is not equipped with a high-performance and expensive valve device such as an extraction steam control valve and adopts high-pressure steam condition where it is difficult to exercise control based on the pressure difference reference method.

To achieve the above-mentioned object, the present invention provides a steam turbine plant comprising a steam extraction control system configured such that only an extracted steam flow measurement value measured by an extraction steam flowmeter is taken as an index of a steam extraction state and an extraction steam stop valve is controlled based on the extracted steam flow measurement.

Specifically, according to one aspect of the present invention, there is provided a steam turbine plant which includes an extraction system which extracts a portion of main steam from an intermediate stage of a steam turbine and delivers the extracted steam to a demander, and a steam extraction control system for controlling the steam extraction of the stem extraction system. In the steam turbine plant, the extraction system includes an extraction steam flowmeter and an extraction steam stop valve, and the control system is configured to be able to set a warning flow and an extracted steam stop flow as restrictive flow values with respect to a flow of the extracted steam. When an extracted steam flow measurement value from the flowmeter reaches the warning flow, a warning is issued, and after a lapse of a predetermined time period, an opening instruction is sent to the stop valve so as to bring the stop valve into a fixed open state for restriction of an extracted steam flow. When in the restriction state the extracted steam flow is further increased and the extracted steam flow measurement value reaches the extracted steam stop flow, a fully-closing instruction is sent to the stop valve to fully close the stop value for stoppage of steam extraction.

As described above, the steam extraction control system is configured such that only an extracted steam flow measurement value measured by an extraction steam flowmeter is taken as an index of a steam extraction state and an extraction steam stop valve is controlled based on the extracted steam flow value. Thus, the steam turbine plant can exercise extraction control capable of stably supplying extracted steam while it is primarily intended that the turbine can continuously be operated by avoiding occurrence of the turbine trip due to steam extraction even if the steam turbine plant is not equipped with a high-performance and expensive valve device such as an extraction steam control valve and adopts high-pressure steam condition where it is difficult to exercise control based on the pressure difference reference method.

The steam turbine plant configured as above can exercise effective steam extraction control using even an extraction steam stop valve with simple structure. Therefore, it is preferred that an extraction steam stop valve be used that can selectively take any one of three valve states comprising a fully-closed state, a fully-opened state and the fixed open state.

Since the steam extraction control is exercised using such a stop valve with simple structure, cost required for a valve device can be reduced, thereby reducing the cost of the steam turbine plant accordingly.

Preferably, in the steam turbine plant, the steam extraction control system includes restrictive flow setting unit for setting the restrictive flow values, and the restrictive flow value setting unit takes any one of a main steam flow, turbine output and post-turbine-first-stage pressure in the steam turbine as an extracted steam flow parameter and sets the restrictive flow values on the basis of the parameter and the extracted steam flow measurement value.

In this way, steam extraction that accounts for the permissible range at a maximum can be performed for the main steam flow, thereby enabling stabler delivery of extracted steam.

According to the present invention described above, a steam turbine plant can exercise extraction control capable of stably supplying extracted steam while it is primarily intended that the turbine can continuously be operated by avoiding occurrence of the turbine trip due to steam extraction even if the steam turbine plant is not equipped with a high-performance and expensive valve device such as an extraction steam control valve and adopts high-pressure steam condition where it is difficult to exercise control based on the pressure difference standard method.

BRIEF DESCRIPTION OF THE DRAWINGS

FIG. 4 is a chart illustrating the relationships between the steam condition and a turbine expansion line and between a difference between a turbine steam extraction point and turbine thermal stress restriction value, and the steam condition.

Figure 1:
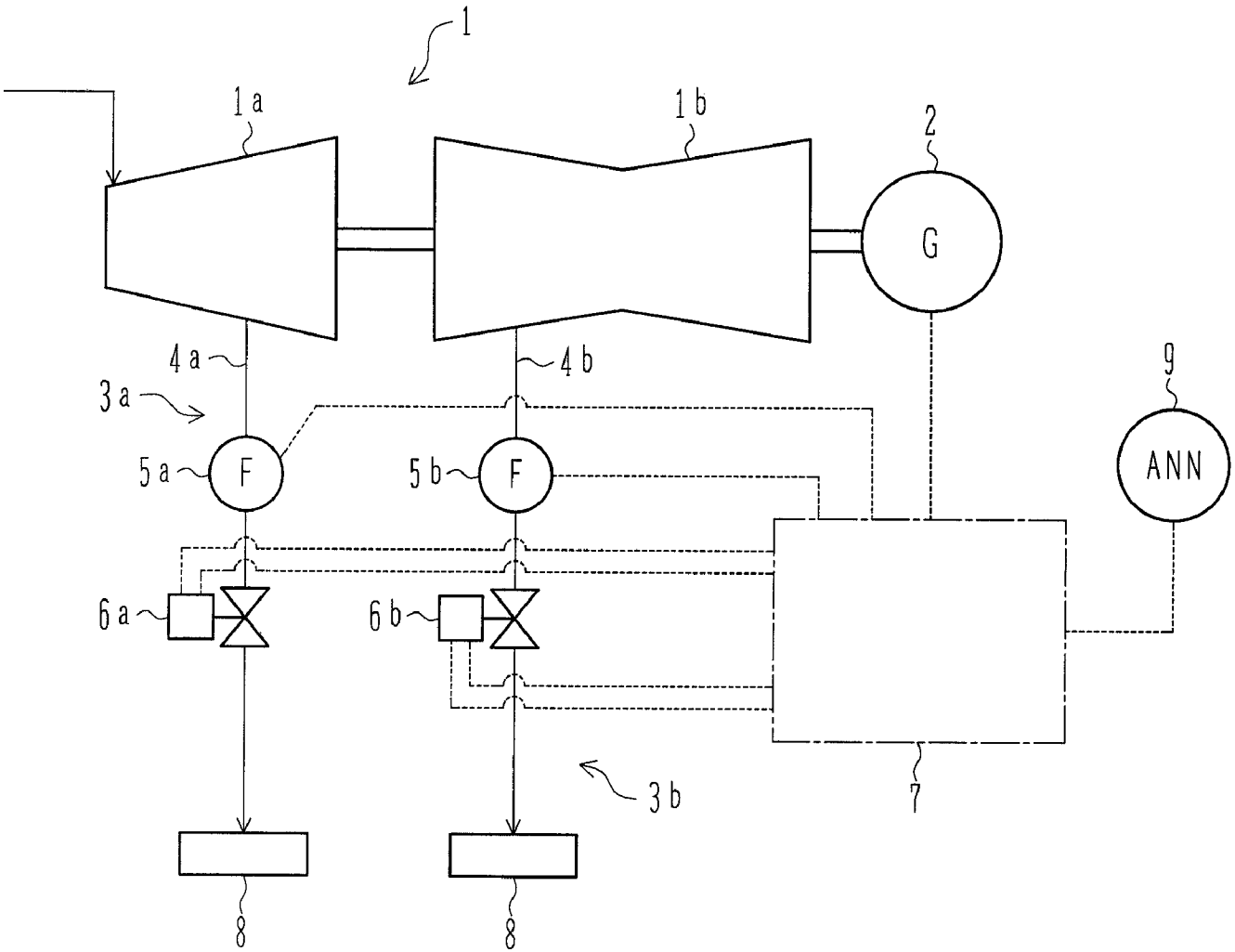
FIG. 1 is a diagram illustrating a system configuration of an extraction steam turbine plant according to an embodiment of the present invention.

Reference numerals are briefly explained below.

1 . . . extraction steam turbine, 3 (3*a*, 3*b*) . . . extraction system, 4 (4*a*, 4*b*) . . . extraction steam supply pipe, 5 (5*a*, 5*b*) . . . extraction steam flowmeter, 6 (6*a*, 6*b*) . . . extraction steam stop valve, 7 . . . steam extraction control system, 8 . . . extracted steam demander, 9 . . . warning device, 11 . . . restriction flow value setting unit

DETAILED DESCRIPTION OF THE PREFERRED EMBODIMENTS

An embodiment of the present invention will be described below. FIG. 1 is a systematic diagram of a configuration of an extraction steam turbine plant according to an embodiment of the present invention. The extraction steam turbine plant is for power generation and includes an extraction steam turbine 1 and a generator 2 connected thereto. The extraction steam turbine 1 is composed of a high-pressure turbine 1*a* and a reheat turbine 1*b*. The high-pressure turbine 1*a* and the reheat turbine 1*b* are each provided with an extraction system 3 (3*a*, 3*b*). The reason why the extraction system 3 is composed of two extraction systems 3*a*, 3*b* is that the extraction systems 3*a*, 3*b* are selectively used according to the pressure state of main steam to more stably supply extracted steam. More specifically, the extraction system 3*b* is used to supply extracted steam in the normal state and the extraction systems 3*a*, 3*b* are used when the pressure of main steam drops lower than a predefined level. Thus, the stability of the extracted steam supply is enhanced.

The extraction system 3 includes an extraction steam supply pipe 4 (4*a*, 4*b*) connected to an intermediate stage of the extraction steam turbine 1 (high-pressure turbine 1*a*, reheat turbine 1*b*); an extraction steam flowmeter 5 (5*a*, 5*b*) provided in the middle of the extraction steam supply pipe 4; and an extraction steam stop valve 6 (6*a*, 6*b*) provided in the middle of the extraction steam supply pipe 4. Extracted steam is delivered to an extracted steam demander 8 under the control of an extracted steam control system 7.

The extraction steam flowmeter 5 measures the flow volume of extracted steam flowing in the extraction steam supply pipe 4 and inputs the measurement to the steam extraction control system 7.

The extraction steam stop valve 6 is driven in an openable and closable manner by e.g. an electric motor. This stop valve 6 is an inexpensive valve device that is simply configured so as to take three states: a fully-closed state, a fully-open state and a predefined intermediate-open state. Such three valve states set the steam extraction states of the extraction system 3.

Figure 2:
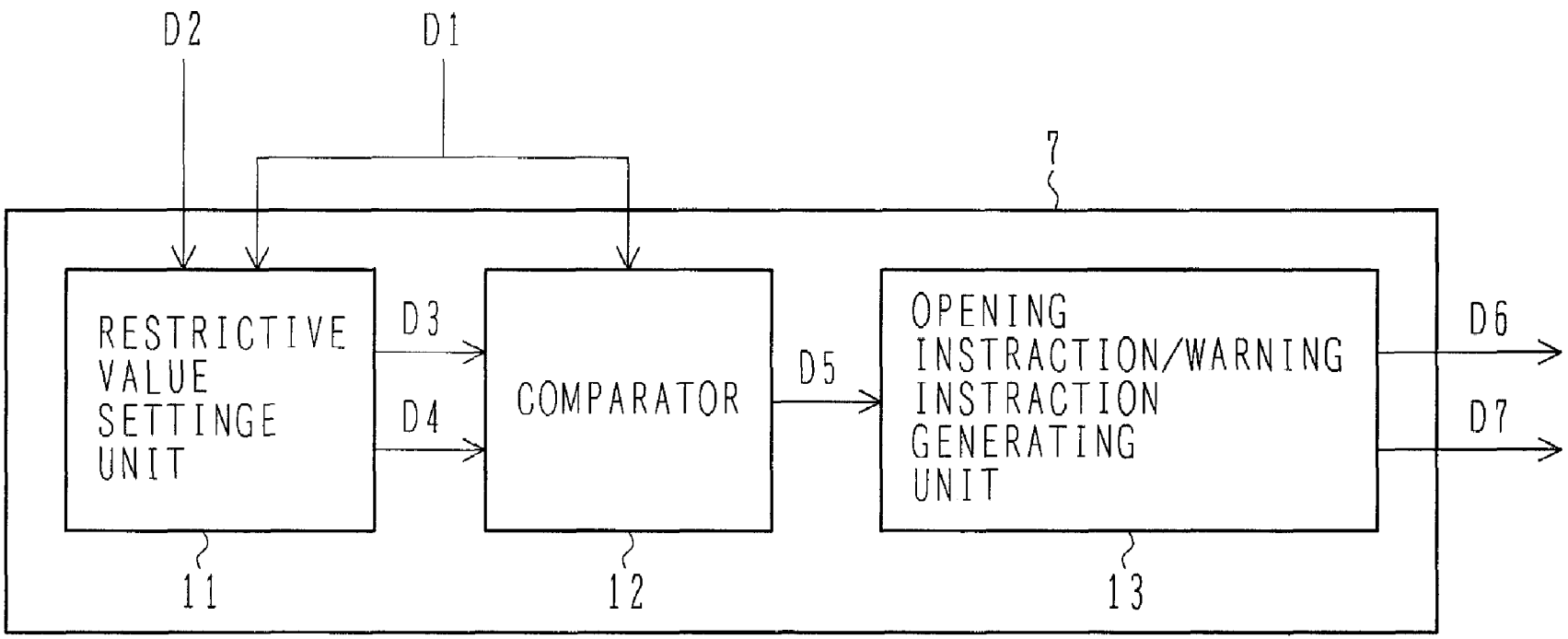
FIG. 2 is a diagram illustrating a configuration of a steam extraction control system.
Figure 3:
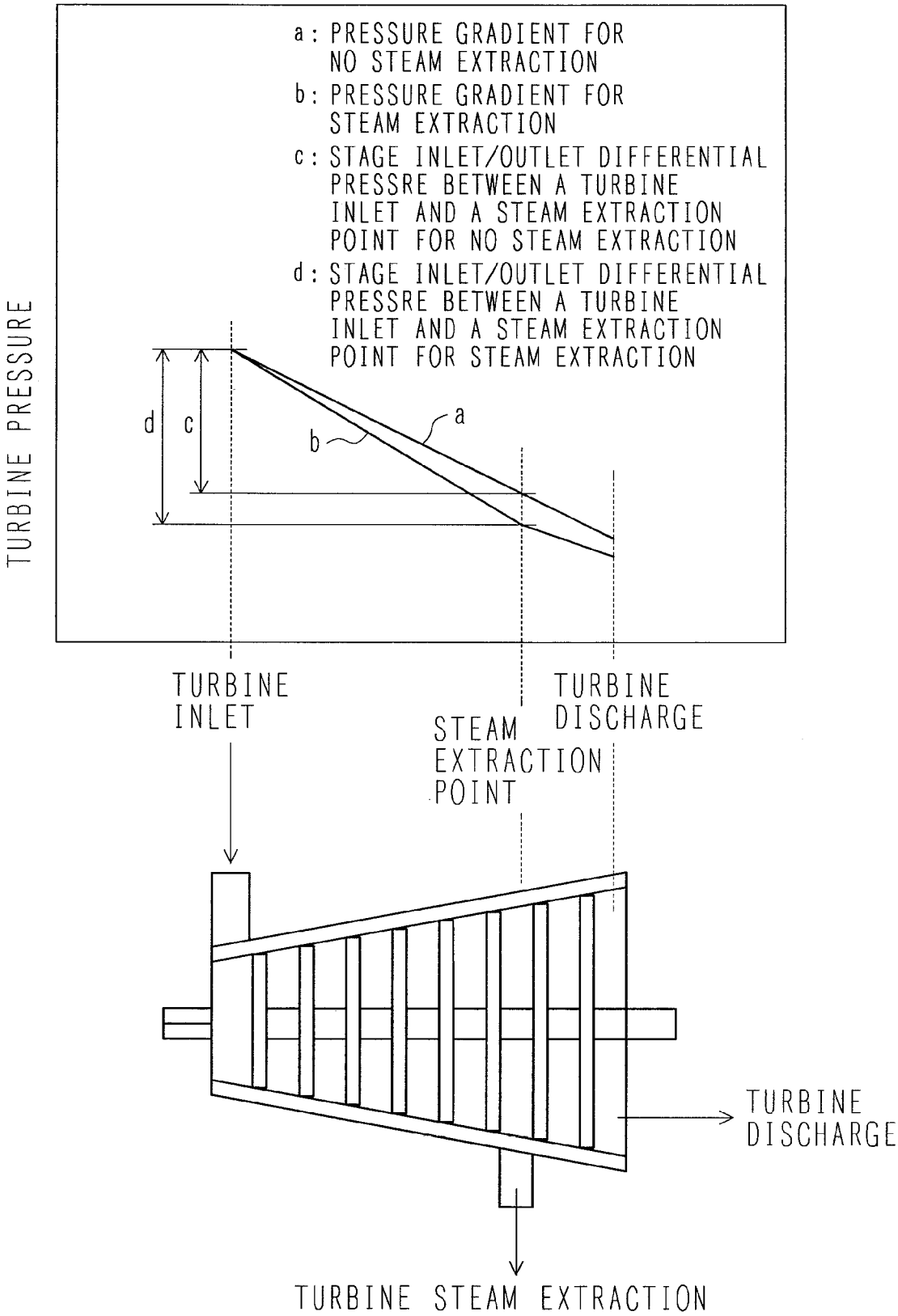
FIG. 3 is a diagram illustrating the relationship between a steam extraction structure and stage inlet/outlet steam differential pressure due to steam extraction.

The steam extraction control system 7 controls the extraction steam stop valve 6 based on the extracted steam flow measurement value obtained by the flowmeter 5. The steam extraction control system 7 is configured as shown in FIG. 2 by way of example to exercise such control. This steam extraction control system 7 includes restrictive flow setting unit 11, comparator 12, and opening instruction/warning instruction generating unit 13.

The restrictive flow setting unit 11 sets two restrictive flow values, a warning flow D3 and an extracted steam stop flow D4, based on an extracted steam flow measurement value D1 and extracted steam flow parameter D2. The extracted steam flow parameter D2 uses the flow of main stream delivered to the extraction steam turbine 1 or a turbine output corresponding thereto, or post-turbine-first-stage pressure. Thus, an instrument for measuring the main stream flow is provided; however, it is not shown in the figure. The extracted steam flow parameter D2 such as the main steam flow and the restrictive flow resulting from the extracted steam flow are set as above. This is because the permissible amount of extracted steam in the extraction steam turbine 1 is correlated with the main steam flow. Specifically, the stage inlet/outlet steam differential pressure in the extraction steam turbine 1 is correlated with the main steam flow. If the main steam flow is small, the inter-state differential pressure decreases. The percentage of the permissible amount of extracted steam can be increased accordingly. Thus, steam extraction that accounts for the permissible range at a maximum can be performed by correlating the restrictive flow with the main steam flow.

The comparator 12 compares the extracted steam flow measurement value D1 with the warning flow D3 and with the extracted steam stop flow D4 to provide a comparison result D5, which is output to the opening instruction/warning instruction generating unit 13.

Based on the comparison result the opening instruction/warning instruction generating unit 13 creates an opening instruction D6 for the extraction steam stop valve 6 and a warning instruction D7 for the warning device 9 (FIG. 1).

Under the control of the steam extraction control system 7 as described above, the normal steam extraction is performed with the extraction steam stop valve 6 brought into the fully-open state. The extracted steam flow corresponding to the demand of the extracted steam demander 8 is extracted. In this state, when the extracted steam flow increases and the extracted steam flow measurement value D1 obtained by the flowmeter 5 reaches the warning flow, the control system 7 issues the warning instruction D7 to allow a warning device 9 to give an alarm. In addition, the control system 7 notifies the demander 8 of the fact that since the extracted steam flow is excessive, the extracted steam flow is likely to be restricted or the steam extraction is likely to be stopped. The extracted steam flow measurement value may have still reached the warning flow after a lapse of a predetermined period time after the extracted steam flow excessive warning has been issued. The predetermined period time is a time period that the demander 8 approximately takes to appropriately deal with restriction of the extracted steam flow or with the stoppage of steam extraction. In this case, the control system 7 sends a signal of an intermediate opening instruction as the opening instruction D6 to the extraction steam stop valve 6. Thus, the extraction steam stop valve 6 is intermediately opened to appropriately restrict the extracted steam flow.

In the state where the extraction steam stop valve 6 is intermediately opened, if the extracted steam flow is increased and the extracted steam flow measurement value D1 reaches an extracted steam stop flow, the control system 7 sends a fully-closed instruction signal as an opening instruction D6 to the extraction steam stop valve 6 to be fully closed for stopping steam extraction.

As described above, in the present invention, the two restrictive flow values for the warning flow and the extracted steam stop flow are set to control steam extraction, when the extracted steam flow is about to exceed the warning flow, a warning is issued to the extracted steam demander for advance notice, and thereafter the extracted steam valve 6 is intermediately opened to appropriately restrict steam extraction. In this state, if the extracted steam flow is further increased and then is about to exceed the extracted steam stop flow, the extraction steam stop valve 6 is fully closed to stop steam extraction. With such steam extraction control, a steam turbine plant can exercise extraction control capable of stably supplying extracted steam while it is primarily intended that the turbine can continuously be operated by avoiding occurrence of the turbine trip due to steam extraction even if the steam turbine plant is not equipped with a high-performance and expensive valve device such as an extraction steam control valve and adopts high-pressure steam condition where it is difficult to exercise control based on the pressure difference reference method.

What is claimed is:

1. A steam turbine plant comprising: an extraction system which extracts a portion of main steam from an intermediate stage of a steam turbine and delivers the extracted steam to a demander; and a steam extraction control system for controlling steam extraction of the extraction system;

wherein the extraction system includes an extraction steam flowmeter and an extraction steam stop valve; and the steam extraction control system is configured to set a warning flow and an extracted steam stop flow as restrictive flow values with respect to a flow of the extracted steam whereby when an extracted steam flow measurement value from the flowmeter reaches the warning flow, a warning is issued and after a lapse of a predetermined time period an opening instruction is sent to the stop valve so as to bring the stop valve into a fixed open state for restriction of the extracted steam flow, and when in the restriction state the extracted steam flow is further increased and the extracted steam flow measurement value reaches the extracted steam stop flow, a fully-closing instruction is sent to the stop valve so as to fully close the stop valve for stoppage of steam extraction.

2. The steam turbine plant according to claim 1, wherein the extraction steam stop valve selectively takes any one of three valve-states comprising a fully-closed state, a fully-opened state and an intermediate-open state as a fixed open state.

3. The steam turbine plant according to claim 1, wherein the steam extraction control system includes restrictive flow value setting means for setting said restrictive flow values; and the restrictive flow value setting means comprises any one of a main steam flow, turbine output and post-turbine-first-stage pressure in the steam turbine as an extracted steam flow parameter and sets the restrictive flow values on the basis of the parameter and the extracted steam flow measurement value.

* * * * *